US007469896B2

(12) United States Patent
Sato et al.

(10) Patent No.: US 7,469,896 B2
(45) Date of Patent: Dec. 30, 2008

(54) SHEET STACKING APPARATUS AND IMAGE FORMING SYSTEM EQUIPPED THEREWITH

(75) Inventors: Hiroyasu Sato, Machida (JP); Hisao Hosoya, Sagamihara (JP); Toshio Shida, Higashiyamato (JP)

(73) Assignee: Konica Minolta Business Technologies, Inc. (JP)

( * ) Notice: Subject to any disclaimer, the term of this patent is extended or adjusted under 35 U.S.C. 154(b) by 486 days.

(21) Appl. No.: 11/036,929

(22) Filed: Jan. 14, 2005

(65) Prior Publication Data

US 2005/0285334 A1 Dec. 29, 2005

(30) Foreign Application Priority Data

Jun. 23, 2004 (JP) ..... 2004-184845
Dec. 6, 2004 (JP) ..... 2004-352527

(51) Int. Cl.
*B65H 39/10* (2006.01)

(52) U.S. Cl. ..... 271/287; 271/288; 271/289; 271/290; 271/298; 271/299

(58) Field of Classification Search ..... 271/287, 271/288, 289, 290, 298, 299, 300
See application file for complete search history.

(56) References Cited

U.S. PATENT DOCUMENTS 3,907,274 A * 9/1975 D'Amato et al. ..... 271/300
4,012,032 A * 3/1977 Rogers ..... 271/290
4,204,670 A * 5/1980 Traister ..... 271/287
5,931,463 A * 8/1999 Kaneda ..... 271/296

FOREIGN PATENT DOCUMENTS

JP P09-301618 11/1997
JP P2004-059268 2/2004

* cited by examiner

*Primary Examiner*—Patrick Mackey
*Assistant Examiner*—Thomas A Morrison
(74) *Attorney, Agent, or Firm*—Squire, Sanders & Dempsey L.L.P.

(57) ABSTRACT

An image forming system includes: a first sheet stacking device including a rack, provided downstream of an image forming apparatus in a conveyance direction of a recording sheet and connected with the image forming apparatus, for stacking the recording sheet delivered from the image forming apparatus; a second sheet stacking device, which is provided downstream of the first sheet stacking device and connected with the first sheet stacking device; and a controller for controlling the image forming apparatus and the first and second sheet stacking devices. At least one of the first and second sheet stacking devices has a job stop button for stopping a printing job, and when the job stop button is turned on while the printing job execution is in progress, the controller controls the sheet stacking device to stop a stack of a recording sheet to the rack.

3 Claims, 9 Drawing Sheets

FIG. 9 ( a )
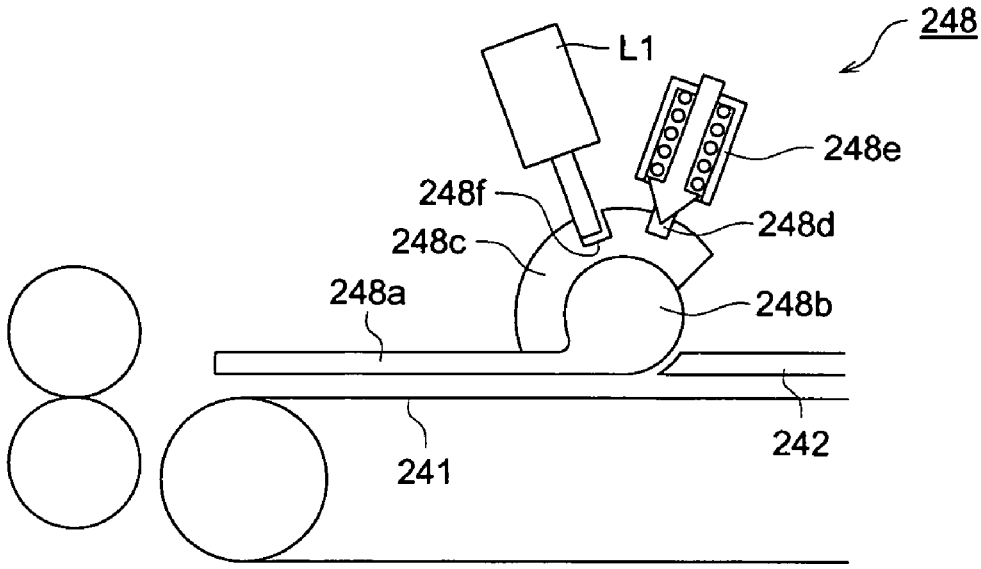
FIG. 9 ( b )
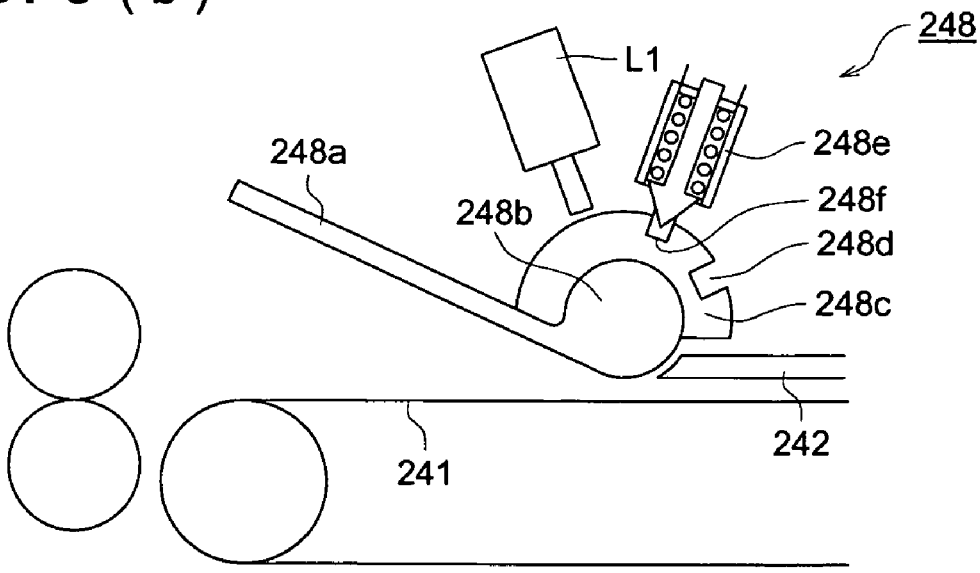

SHEET STACKING APPARATUS AND IMAGE FORMING SYSTEM EQUIPPED THEREWITH

BACKGROUND OF THE INVENTION

The present invention relates to sheet stacking apparatuses that make it possible to stack plural sheets of paper discharged by an image forming apparatus, and to image forming systems in which an image forming apparatus is connected to a sheet stacking apparatus.

In an image forming apparatus, plural stages of sheet discharge trays are provided to separate and discharge sheets of paper on which images have been formed, and sheets are discharged to the discharge tray selected by the user. In Patent Document 1, a proposal has been made, in a paper discharge apparatus provided with plural stages of sheet discharge trays, to provide input means in an image forming apparatus for changing the destination of discharged sheets for each paper discharge tray, thereby making it possible to select the discharge tray to which the sheet is to be discharged even in the middle of printing.

In a high speed printer, very frequently the image forming is done at a high speed and plural sheets of printed paper are discharged in a very short time, and since the capacity of the paper discharge tray or plural stages of paper discharge trays provided in the image forming apparatus to stack sheets of paper becomes insufficient, a sheet stacking apparatus is connected to the image forming apparatus, and the sheets of paper discharged by the image forming apparatus are stored within the racks of the sheet stacking apparatus having a large sheet storing capacity. In addition, in a similar manner, several units of sheet stacking apparatuses are connected to the image forming apparatus thereby not only increasing the capacity of sheet storage but also making it possible to discharge the paper discharged by the image forming apparatus to the selected sheet stacking apparatus.

In Patent Document 2, in a system of connecting plural paper finishers to an image forming apparatus and carrying out specific finishing, technology has been disclosed to avoid the entire system from getting stopped and become unusable when a specific finishing cannot be executed, wherein the finishing is continued by switching over to another paper finisher.

Patent Document 1: Japanese Patent Application Laid Open No. 2004-59268.

Patent Document 2: Japanese Patent Application Laid Open No. Hei 9-301618.

SUMMARY OF THE INVENTION

The present invention is one that achieves the following objects in an image forming system constituted by connecting plural sheet stacking apparatuses to an image forming apparatus or in a sheet stacking apparatus constituting such an image forming system.

The first object of the present invention is to make it possible for the user to judge the sheet stacking condition of paper stacked within the rack of the sheet stacking apparatus during the execution of a job carrying out continuous printing and to remove sheets of paper from that rack after interrupting that job.

Further, the second object of the present invention is to make it possible for the user to judge the sheet stacking condition of paper stacked within the rack of the sheet stacking apparatus during the execution of a job carrying out continuous printing and to remove sheets of paper from that rack while continuing the execution of the printing job.

The above objects of the present invention can be achieved by any one of the following structures (1) to (14).

(1) An image forming system with the feature that, in an image forming system comprising an image forming apparatus that forms images on paper, a plurality of sheet stacking apparatuses that are connected to the image forming apparatus on the downstream side of paper conveyance direction of the image forming apparatus and that stack the sheets of paper discharged from the image forming apparatus, and a control means that controls the image forming apparatus and the plurality of sheet stacking apparatuses; the plurality of sheet stacking apparatuses includes, at least, a first sheet stacking apparatus connected to the image forming apparatus on the downstream side along the paper conveyance direction and a second sheet stacking apparatus that is connected on the downstream side along the direction of paper conveyance from the first sheet stacking apparatus; includes a sheet stacking rack, and at least one of the plurality of sheet stacking apparatuses contains a job stopping push button for stopping the execution of the current job, and, when the job stopping push button is turned ON during the execution of a printing job, the control means carries out control so that the stacking of paper sheets to the rack is stopped.

(2) An image forming system according to structure (1) above with the feature that the stopping of the stacking of paper sheets on the rack by the control means is done after the completion of stacking of the sheet of paper on which image formation is in progress at that time.

(3) An image forming system according to structure (1) or (2) above with the feature that the control means carries out the control of moving the rack from the stacking position at which sheets are stacked on it to the removal position at which sheets on it are removed, after the stacking of paper on the rack has been completed.

(4) An image forming system with the feature that, in an image forming system comprising an image forming apparatus that forms images on paper, a first sheet stacking apparatus that is connected to the image forming apparatus on the downstream side of paper conveyance direction of the image forming apparatus and that stacks the sheets of paper discharged from the image forming apparatus, a second sheet stacking apparatus that is connected on the downstream side along the direction of paper conveyance of the first sheet stacking apparatus, and a control means that controls the image forming apparatus, the first sheet stacking apparatus, and the second sheet stacking apparatus; and the first sheet stacking apparatus includes a rack that can move to the stacking position at which sheets are stacked on it and to the removal position at which sheets are removed from it, a stacking path for conveying paper sheets to be stacked on the rack, a discharge path for discharging paper to the downstream side along the direction of paper conveyance from the first sheet stacking apparatus, a conveyance path switching means for switching the paper conveyance path between the stacking path and the discharge path, and a conveyance path changing button for instructing to change the paper conveyance path; and the control means carries out, when the conveyance path changing button is turned ON during the execution of a printing job, control of switching the conveyance path switching means from the stacking path of conveying paper to stack on the rack of the first sheet stacking apparatus to the discharge path of discharging paper sheets to the downstream side along the paper conveyance direction from the first sheet stacking apparatus, so that paper sheets are conveyed to and stacked on the rack of the second sheet stacking apparatus on the downstream side along the paper conveyance direction.

(5) An image forming system according to structure (4) above with the feature that the control means carries out control so that the subsequent sheets of paper being conveyed on the upstream side of the conveyance path switching means are conveyed to the discharge path after the change has been made in the conveyance path.

(6) An image forming system according to structure (4) or (5) above with the feature that the control means carries out the control of moving the rack of the first sheet stacking apparatus from the stacking position at which sheets are stacked on it to the removal position at which sheets on it are removed, after the stacking of paper on the rack of the first sheet stacking apparatus has been completed.

(7) An image forming system according to structure (4), (5), or (6) above with the feature that the control means carries out, when the conveyance path changing button is turned ON, the control so as to inhibit the opening of the conveyance guide section that can get opened and closed and that forms the paper conveyance path.

(8) A sheet stacking apparatus with the feature that, a sheet stacking apparatus that is connected to an image forming apparatus and that stacks the sheets of paper discharged from the image forming apparatus comprises a rack that moves down in accordance with the quantity of sheets stacked on it and also is capable of moving down from the stacking position at which paper sheets are stacked on it to the specified removal position for removing the paper sheets, a stacking path for conveying the sheets of paper discharged from the image forming apparatus in order to stack them onto the rack, a job stopping button for stopping the printing job, and a control means for controlling the sheet stacking apparatus; and, when the job stopping push button is turned ON during the execution of a printing job, the control means carries out control so that the stacking of paper sheets to the rack is stopped.

(9) A sheet stacking apparatus according to structure (8) above with the feature that the stopping of the stacking of paper sheets on the rack by the control means is done after the completion of stacking of the sheet of paper on which image formation is in progress at that time.

(10) A sheet stacking apparatus according to structure (8) or (9) above with the feature that the control means carries out the control of moving the rack from the stacking position at which sheets are stacked on it to the removal position at which sheets on it are removed, after the stacking of paper on the rack has been completed.

(11) A sheet stacking apparatus with the feature that, the sheet stacking apparatus that is connected to an image forming apparatus and that stacks the sheets of paper discharged from the image forming apparatus comprises a rack that moves down in accordance with the quantity of sheets stacked on it and also is capable of moving down from the stacking position at which paper sheets are stacked on it to the specified removal position for removing the paper sheets, a stacking path for conveying the sheets of paper discharged from the image forming apparatus to the rack, a discharge path for discharging sheets of paper towards the downstream side of the sheet stacking apparatus, a conveyance path switching means for switching the paper conveyance path between the stacking path and the discharge path, and a conveyance path changing button for changing the paper conveyance path, and a control means for controlling the sheet stacking apparatus; wherein the control means carries out, when the conveyance path changing button is turned ON during the execution of a printing job, control so as to switch the conveyance path switching means from the stacking path of conveying paper to stack on the rack of the sheet stacking apparatus to the discharge path of discharging paper sheets to the rack of some other sheet stacking apparatus.

(12) A sheet stacking apparatus according to structure (11) above with the feature that the control means carries out control so that the subsequent sheets of paper being conveyed on the upstream side of the conveyance path switching means are conveyed to the discharge path.

(13) A sheet stacking apparatus according to structure (11) or (12) above with the feature that the control means carries out the control of moving the concerned rack from the stacking position at which sheets are stacked on it to the removal position at which sheets on it are removed, after the stacking of paper on the concerned rack has been completed.

(14) A sheet stacking apparatus according to structure (11), (12), or (13) above with the feature that the control means carries out, when the conveyance path changing button is turned ON, the control so as to inhibit the opening of the conveyance guide section that can get opened and closed and that forms the conveyance path.

According to the present invention, since by turning ON the job stopping button provided on the concerned sheet stacking apparatus when wanting to take out the sheets of paper stacked on the rack of a sheet stacking apparatus after interrupting the execution of a job carrying out continuous printing, the sheets of paper on which images are being formed are stacked on the concerned rack, and when the stacking of sheets is completed, since the concerned rack moves to the removal position for taking out sheets thereby going into the condition in which it is possible to take out the sheets, there is the excellent effect of improved ease of operation.

Further, according to the present invention, since by turning ON the conveyance path changing button provided on the concerned sheet stacking apparatus when wanting to take out the sheets of paper stacked on the rack of a sheet stacking apparatus while continuing the execution of a job carrying out continuous printing, the sheets of paper other those on the conveyance path of the concerned rack are conveyed to the rack of some other sheet stacking apparatus, and when the stacking of sheets on the concerned rack is completed, since the concerned rack moves to the removal position for taking out sheets thereby going into the condition in which it is possible to take out the sheets, there is the excellent effect of improved ease of operation.

BRIEF DESCRIPTION OF THE DRAWINGS

FIG. 7 is a flow chart when the job stopping button is turned ON.

FIG. 8 is a flow chart when the conveyance path changing button is turned ON.

FIGS. 9(*a*) and 9(*b*) are configuration diagrams of the conveyance guide section.

DETAILED DESCRIPTION OF THE PREFERRED EMBODIMENT (1) A preferred embodiment of the sheet stacking apparatus according to the present invention is described in detail in the following with reference to the drawings.

Figure 1:
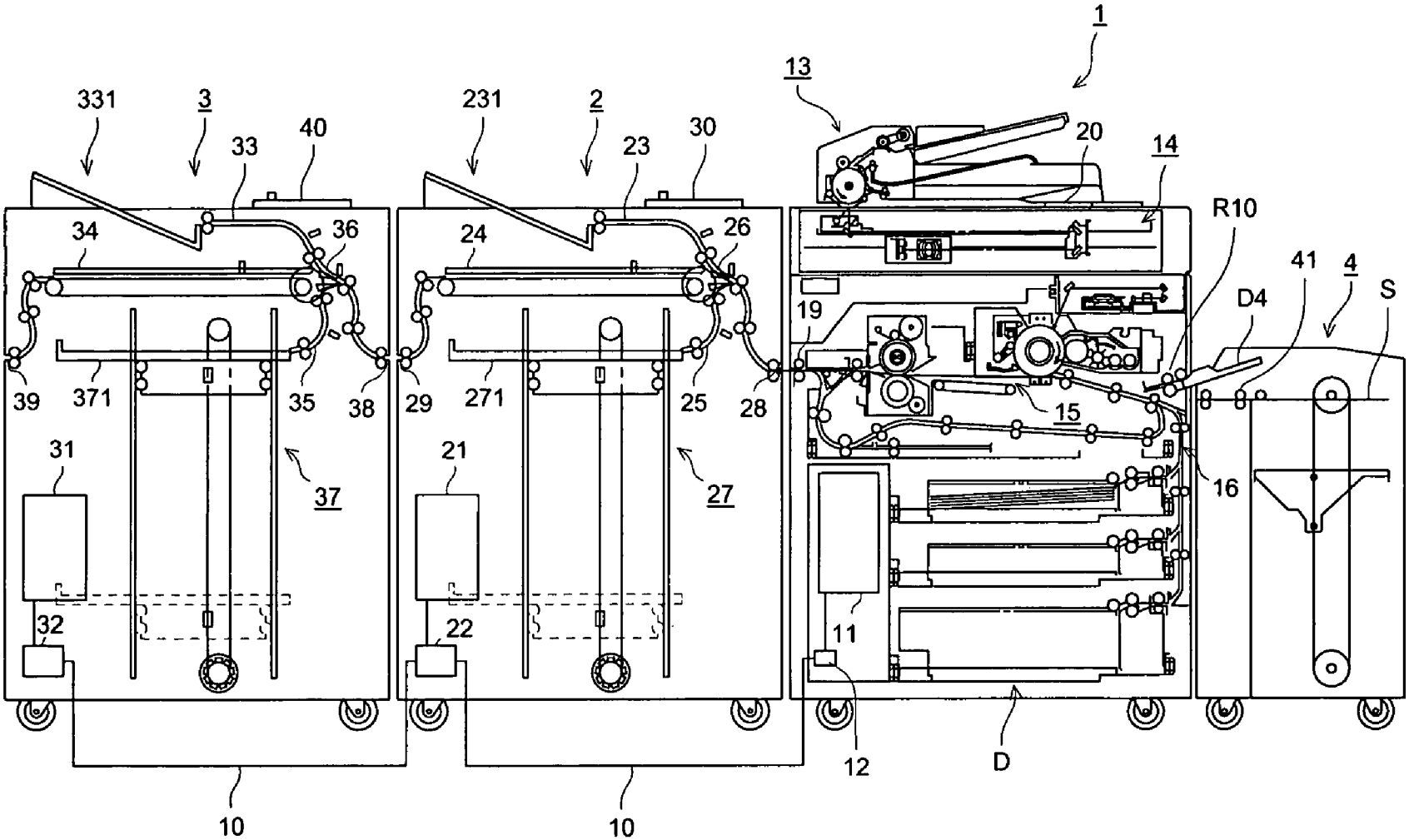
FIG. 1 is an overall configuration diagram of an image forming system in which two sheet stacking apparatuses are connected to an image forming apparatus.
Figure 2:
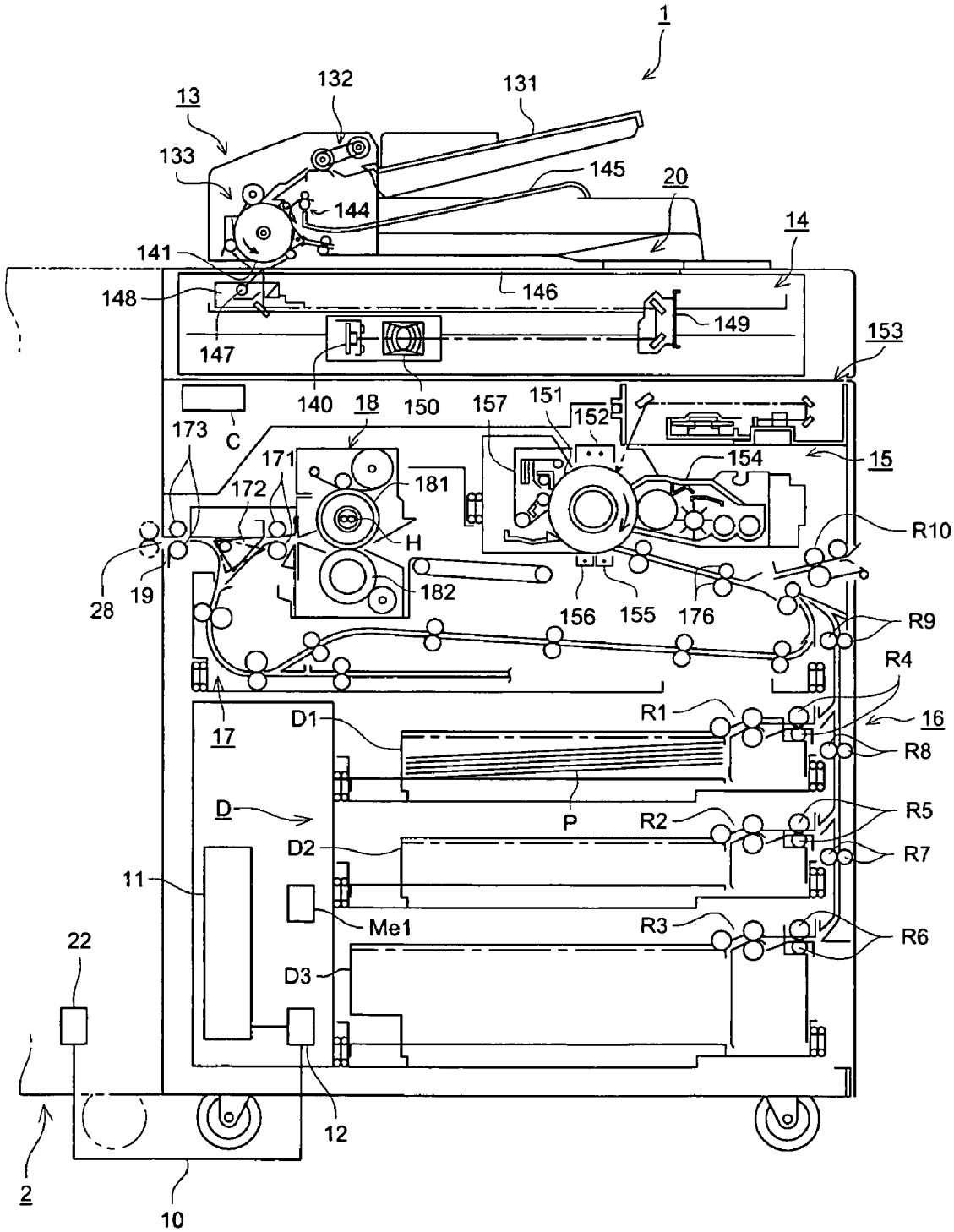
FIG. 2 is a configuration diagram of an image forming apparatus.

Firstly, the configurations of an image forming apparatus and a sheet stacking apparatus are described here referring to FIGS. 1 and 2. FIG. 1 is an overall configuration diagram of an image forming system in which plural (two in this case) sheet stacking apparatuses and a large quantity sheet feeder are connected to an image forming apparatus, and FIG. 2 is the configuration diagram of only the image forming apparatus.

In FIG. 1, numeral 1 is the image forming apparatus, numeral 2 is the first sheet stacking apparatus connected to the image forming apparatus 1 on the downstream side of the paper conveyance direction and which stacks the sheets of paper discharged from the image forming apparatus 1, numeral 3 is the second sheet stacking apparatus connected to the first sheet stacking apparatus on the downstream side of the paper conveyance direction, and numeral 4 is the large quantity sheet feeder connected to the image forming apparatus 1. Further, although FIG. 1 is a diagram showing two sheet stacking apparatus connected to the image forming apparatus, it is possible to connect three or more sheet stacking apparatus also.

To begin with, the sheet of paper P on which image has been formed by the image forming apparatus 1 is discharged from the discharge outlet 19 and is conveyed to the receiving inlet 28 or 38 of plural sheet stacking apparatuses connected in the downstream side of the paper conveyance direction, in FIG. 1, either of the first sheet stacking apparatus 2 or of the second sheet stacking apparatus 3.

Next, depending on the state of the conveyance path switching means 26 and 36 that change the conveyance path of the sheet stacking apparatuses 2 and 3, the sheet of paper P is either discharged to the sheet ejection section 231 or 331 above the sheet stacking apparatus via the sheet ejection path 23 or 33, or is conveyed to further downstream side via the discharge path 24 or 34, passed through the stacking path 25 or 35, and is successively stacked on the rack 271 or 371 or the stacking means 27 or 37.

Further, the control sections 11, 21, and 31 of the different apparatuses are provided as the control means according to the present invention. The communication means 12 of the image forming apparatus 1 is connected to the communication means 22 and 32 of the sheet stacking apparatuses 2 and 3 are connected by communication member 10. The control sections 11, 21, and 31 of different apparatuses that are the control means control the different sections by mutually exchanging, via the communication means 12, 22, and 32, the information related to the conveyance status of the paper P or the information about the operating statuses of the different members and sections.

Here, the each of the communication means is provided with a parallel to serial converter, not shown in the figure, which converts the parallel data signal of the control section into serial data signal in the communication means, or vice versa, and the exchange of information is between the different apparatuses is done via the communication member 10 which is made up of serial communication cables.

Further, the image forming apparatus 1 is provided with the automatic document feeder 13, the image reading apparatus 14, the image forming section 15, the sheet storage section D, the paper feeder 16, and the operation section 20, and carries out image formation on the paper P.

(2) Next, the configuration of the image forming apparatus is described here referring to FIG. 2. FIG. 2 is an outline cross-sectional diagram of an image forming apparatus.

Firstly, the image forming apparatus 1 is provided with the automatic document feeder 13, the image reading apparatus 14, the image processing section C, the image forming section 15, the sheet storage section D, the paper feeder 16, the sheet reversing conveyance section 17, and the operation section 20.

The automatic document feeder 13 is an apparatus that sends out the document one sheet at a time and conveys it to the image reading position, and carries out the paper discharging process of ejecting the document to the specific location when the reading of that document has been completed. Further, the plural sheets of paper, not shown in the figure, that are placed on the document loading table 131 are separated into single sheets by the document separating means 132 and conveyed by the document conveyance means 133 to the image reading position.

The document reading position is located on the downward side of the document conveyance means 133, and is such that the image on the document is read out through the slit 141 of the image reading apparatus 14. The document whose image has been read is ejected on to the document ejection table 145 by the document ejecting means 144.

Further, the configuration is such that the document can be placed directly over the plate glass 146 and the document can be copied in that position.

The image reading apparatus 14 is a device for reading the image on the document and obtaining the image data, and when the automatic document feeder is used, the slit 141 is illuminated by the lamp 147 for illuminating the document, and the light reflected from the document is reflected by the first mirror unit 148 and by the second mirror unit 149, and the reflected light is focused via the imaging lens 150 on to the line shaped CCD 140 which is the imaging device, thereby carrying out photoelectric conversion of the optical image of the document.

Further, when using the plate glass 146, the first mirror unit 148 and the second mirror unit 149 are moved, and in a manner similar to the above, the reflected light from the document is focused on to the CCD 140 by the imaging lens 150 thereby carrying out photoelectric conversion of the optical image of the document.

The analog signal obtained by photoelectric conversion is A/D converted after analog signal processing, and is then subjected to various appropriate image processing operations such as shading correction, filter processing, and gamma correction etc., in the image processing section C thereby converting it into the image data which is then stored temporarily in the memory Me1.

The image forming section 15 carries out image formation using the electro-photography process. In order to form the toner image on the image carrier, first, the surface of the photo-sensitive drum 151, which is an image carrier having a photoconductive photosensitive layer on its surface and which is rotated in the direction of the arrow by an appropriate driving means, is charged uniformly by the electrostatic charging unit 152.

After that, based on the image data read out from the memory Me1, the surface of the photosensitive drum 151 is exposed to light using the dot exposure method by the laser writing system 153 which is an exposure means for forming the electrostatic latent image thereby forming the electrostatic latent image corresponding to the image on the original document, and the electrostatic latent image formed on the photosensitive drum 151 is reversal developed to form the toner image by the developing unit 154.

Next, the apparent toner image is transferred via the operation of the transfer electrode 155 on to the paper P, which is fed by the starting of rotation of the registration roller 176 in synchronization with the forming of the toner image, AC corona discharge is made using the discharging unit 156 from the reverse side of the paper onto which the toner image has been transferred thereby separating the paper P from the surface of the photosensitive drum 151.

Next, the paper P so separated is conveyed between the heating roller 181 having an internal heater H and the pressure roller 182 that rotates while pressing against the heating roller of the fixing apparatus 18, and the toner image on the paper P is fixed by applying pressure and heat at the same time.

The paper P on which the toner image has been fixed passes through the fixer discharge roller 171, the selection means 172, the paper discharge roller 173, and the discharge outlet 19 and is fed to the receiving inlet 28 of the first sheet stacking apparatus 2 connected on the downstream side.

Further, the surface of the photosensitive drum 151 after the transfer has been completed is cleaned by the cleaning means 157.

Coming to the explanation of the supply of paper to the registration roller mentioned above, based on the paper size information, etc., that have been input by the operator from the operation section 20, the paper feeder 16 controlled by the control section 11 drives any one of the paper feed rollers R1, R2, and R3 of the paper feed tray in which the paper of the specified size has been set among the paper feed trays D1, D2, and D3 of the paper storage section D, thereby feeding the paper of the specific size.

Further, as is shown in FIG. 1, in the case of manual paper feed, the paper P is placed in the manual feed tray D4, and when a large quantity of paper is to be fed, the sheets of paper are placed in the large capacity tray 4, and the paper is conveyed as described earlier.

The paper P so fed is conveyed to the registration roller 176 by the conveyance roller pairs (which may also be referred to in the following as merely "conveyance roller") R4, R5, R6, R7, R8, and R9 of the paper feeder 16.

The paper reversal conveyance section 17 is a paper conveyance section for reversing and discharging the paper P after fixed, or for re-feeding the paper P to the image forming section 15 in accordance with the both sides image forming mode.

Figure 3:
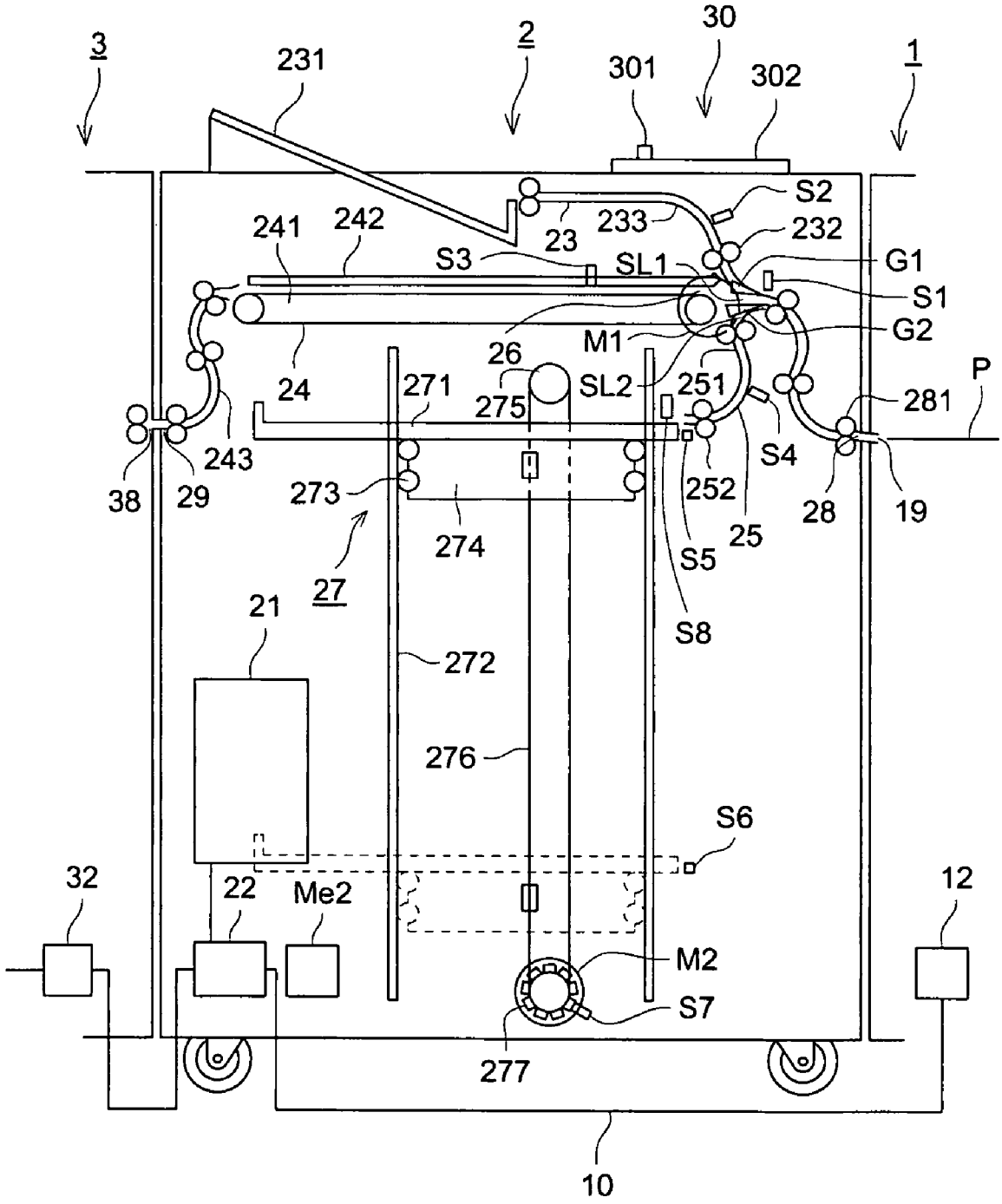
FIG. 3 is a configuration diagram of a sheet stacking apparatus.

(3) Next, the configuration of the first sheet stacking apparatus 2 is described below referring to FIG. 3. FIG. 3 is a configuration diagram of the first sheet stacking apparatus. Further, the description of the second sheet stacking apparatus will be omitted because its configuration is the same as that of the first sheet stacking apparatus.

The first sheet stacking apparatus 2 has been installed adjusting its position and height so that it's receiving inlet 28 and the receiving roller 281 coincide with the discharging outlet 19 of the image forming apparatus 1.

The conveyance path of the paper P connected on the downstream side of the receiving roller 281 is divided into the three systems of the sheet ejection path 23, the discharge path 24, and the stacking path 25, and the paper is conveyed to one of these paths depending on the selection of the angles of the selection gate G1 driven by the solenoid SL1 and of the selection gate G2 driven by the solenoid SL2 which constitute the conveyance path switching means 26.

Further, an opening and closing door is provided on the outside of the front panel of the first sheet stacking apparatus 2, although this door has not been shown in the figure, and by opening this door, it is possible to remove the sheets stacked on the rack 271 or to remove any paper that has got jammed inside.

Figure 4:
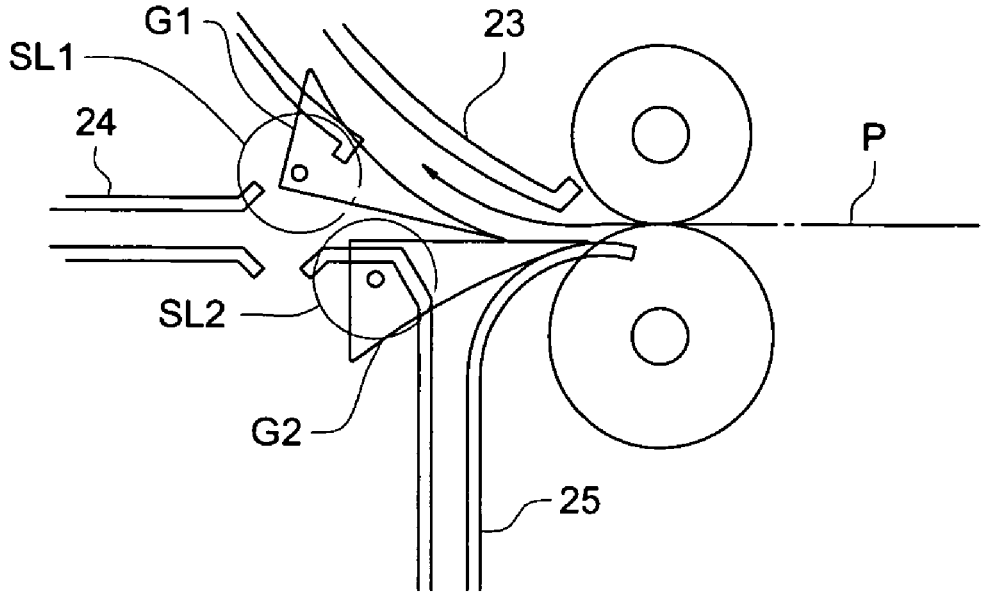
FIGS. 4(*a*) and 4(*b*) are enlarged views of conveyance path switching means.
Figure 4:
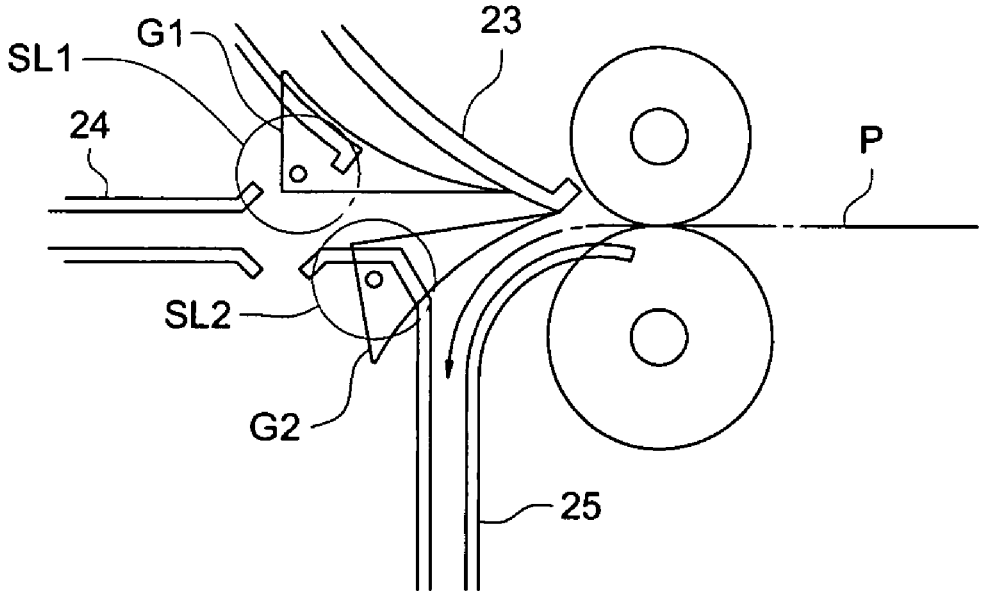

Here the conveyance path switching means 26 is described referring to FIGS. 4(*a*) and 4(*b*). FIG. 4(*a*) shows the conditions when the conveyance path of the paper P has been selected to be the sheet ejection path 23, and FIG. 4(*b*) shows the conditions when the conveyance path of the paper P has been selected to be the stacking path 25.

The solenoids SL1 and SL2 are driven by driver circuits not shown in the figure by the control section 21, and when the solenoid SL1 is ON and the solenoid SL2 is OFF, as is shown in FIG. 4(*a*), the tip of the selection gate G1 on the upstream side comes into contact with the top surface of the selection gate G2 thereby shutting off the path to the discharge path 24 and to the stacking path 25 and also opens the path to the sheet ejection path 23, and since the selection gate G2 shuts out the conveyance path to the stacking path 25 without hindering the operation of the selection gate G1, the paper P will be conveyed to the sheet ejection path 23.

Further, when the solenoid SL1 and the solenoid SL2 are both turned off, since the tip of the selection gate G1 on the upstream side shuts off the conveyance path to the sheet ejection path 23 and also opens the conveyance path to the discharge path 24, and since the selection gate G2 shuts off the conveyance path to the stacking path 25 and also opens the path to the discharge path 24, the paper P will be conveyed to the discharge path 24.

Further, when the solenoid SL2 is turned ON and the solenoid SL1 is turned OFF, as is shown in FIG. 4(*b*), the tip of the selection gate G2 shuts off the path to the sheet ejection path 23 and to the discharge path 24 and also opens the path to the stacking path 25, and since the selection gate G1 shuts out the conveyance path to the sheet ejection path 23 without hindering the operation of the selection gate G2, the paper P will be conveyed to the stacking path 25.

Returning to FIG. 3, the paper P conveyed to the sheet ejection path 23 is guided to the first discharge guide 233, conveyed up to the sheet ejection section 231 by a plurality of conveyance roller pairs 233, and is then ejected and stacked.

Further, the paper P conveyed to the discharge path 24 has the bulging up of its top surface suppressed by the guide member 242, placed on the belt conveyor 241 driven by the motor M1 and is conveyed thereby, passed through the discharge outlet guide 243, and is discharged from the discharge outlet 29 towards the receiving inlet 38 of the second sheet stacking apparatus 3 positioned on the downstream side.

Further, regarding the conveyance to the discharge path 24, the conveyance can also be done similar to the sheet ejection path 23 using guides and conveyance rollers.

In addition, the paper P conveyed to the stacking path 25 is guided by the intermediate guide 251, and is conveyed up to the stacking means 27 by a plurality of conveyance roller pairs 252.

The rack 271 of the stacking means 27 is supported by the rack supporting section 274, the rack supporting section 274 moves up or down by the plurality of rollers 273 provided on both ends in the figure contacting wit the guide members 272 placed vertically.

Further, a pair of pulleys 275 are placed at the top and bottom, the rack supporting section 274 is fixed to the wire 276 kept strung between the pulleys 275, and the rack 271 can be moved from the position shown by solid lines to the position shown by broken lines in the figure by the motor M2 coupled to the bottom one of the pulleys 275. Because of this configuration, by controlling the rotation of the motor M2 by the control section 21, it is possible to move the rack 271 to any desired position.

Here, the upper limit position of the rack 271 is the position shown in the figure by the solid lines at which the sheet of paper P discharged from the stacking path 25 gets stacked on the rack 271 smoothly, and the upper limit sensor S5 detecting the upper limit position of the rack 271 is placed above it. Thus, the upper limit position of the rack 271 is detected by the control section 21.

In a similar manner, the lower limit sensor S6 for detecting the lower limit position of the rack 271 is placed in the lower part and this sensor detects when the rack 271 comes down to the lower limit position.

Further, the output shaft of the motor M2 is provided with a cogwheel 277 having projections and depressions on its periphery for detecting the amount of rotation, the output of the position sensor S7 detecting these projections and depressions is input to the control section 21, and by counting the number of pulse signals from the position sensor S7 detecting the projections and depressions, it is possible to know the current position and the amount of movement from any specific position of the rack 271 when the rack 271 has started moving down and from the time the detection of the upper limit position sensor S4 has ceased, and hence it is possible to carry out the position control of stopping the rack 271 at any desired position.

In addition, a top surface sensor S8 as been installed that detects continuously the top surface of the paper P stacked on the rack 271 and it is possible to position the top surface of the rack 271 at a position slightly lower by the thickness of the paper P than the position of paper discharge from the stacking path 25. In this manner, as several sheets of paper P are stacked successively on the rack 271, the rack 271 is lowered by a distance equal to the thickness of those number of sheets of paper, thereby making the position of the top surface of the rack 271 slightly lower relative to the paper P to be stacked at the topmost position.

Further, the sensor S1 that detects the paper P immediately before the conveyance path switching means 26, the sensor S2 that detects the paper P within the sheet ejection path 23, the sensor S3 that detects the paper P within the discharge path 24, and the sensor S4 that detects the paper P within the stacking path 25 are also provided.

Figure 5:
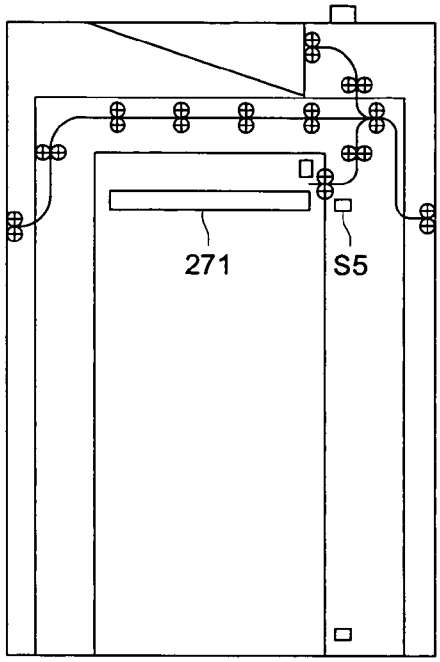
FIGS. 5(*a*)-5(*d*) are schematic diagrams of the sheet stacking apparatus showing the rack movement conditions.
Figure 5:
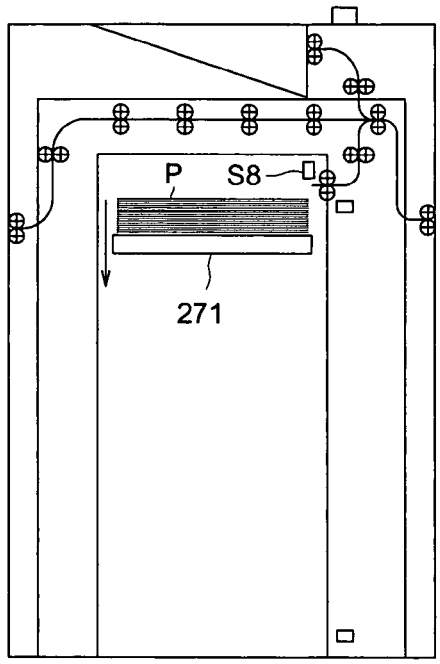
Figure 5:
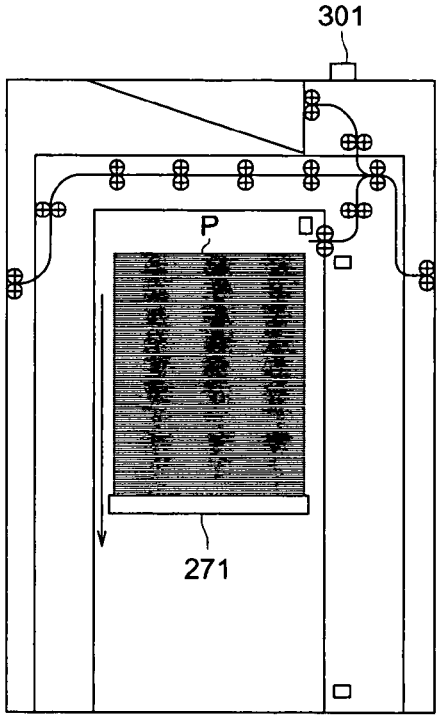
Figure 5:
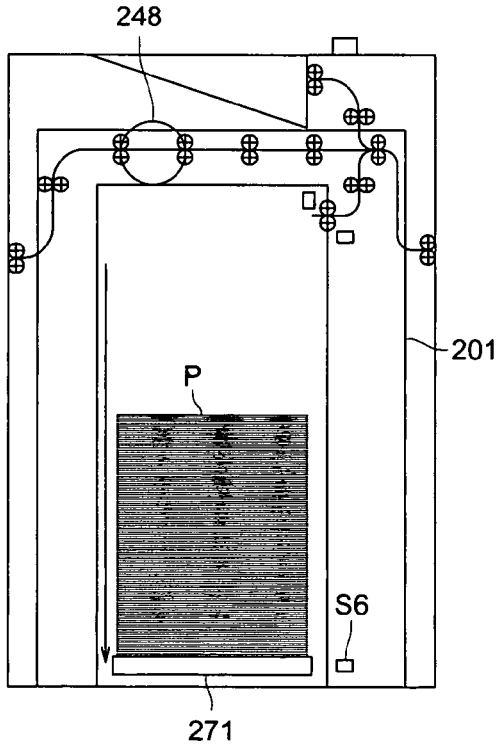

FIGS. 5(*a*) to 5(*d*) are the outline diagrams showing the states of movement of the rack 271 controlled by the control section 21.

FIG. 5(*a*) shows the standby state when stacking paper from the image forming apparatus 1. The rack 271 is positioned at its uppermost position, and the paper P has not yet been placed on the rack 271. During this standby state, the upper limit sensor S5 is detecting the rack 271.

Next, as is shown in FIG. 5(*b*), when the paper P is been taken out from the image forming apparatus 1 and stacked on the rack 271, this is detected by the top surface sensor S8 and the control section 21 rotates the motor M2 thereby lowering the rack 271 by a distance equal to the thickness of the paper. Subsequently, when sheets of paper P are discharged one by one, the rack 271 goes down according to the quantity of paper P stacked.

In at least one of the sheet stacking apparatuses among the plural sheet stacking apparatuses according to the present invention, there is a job stopping button for stopping the execution of the printing job and a conveyance path changing button for changing the conveyance path. The operation section 30 has been provided at the top of the first sheet stacking apparatus of the present preferred embodiment, and a job stopping button 301 and a conveyance path changing button 302 have been provided in this operation section 30. When the job stopping button 301 is turned ON during the execution of a continuous printing job, control is executed so as to stop the conveyance of paper to be stacked on the rack 271. In addition, when the conveyance path changing button 302 is turned ON during the execution of a continuous printing job, control is executed to change the conveyance path from the stacking path 25 of conveying paper to the rack 271 to the discharge path 24. These controls are described in detail later.

Figure 6:
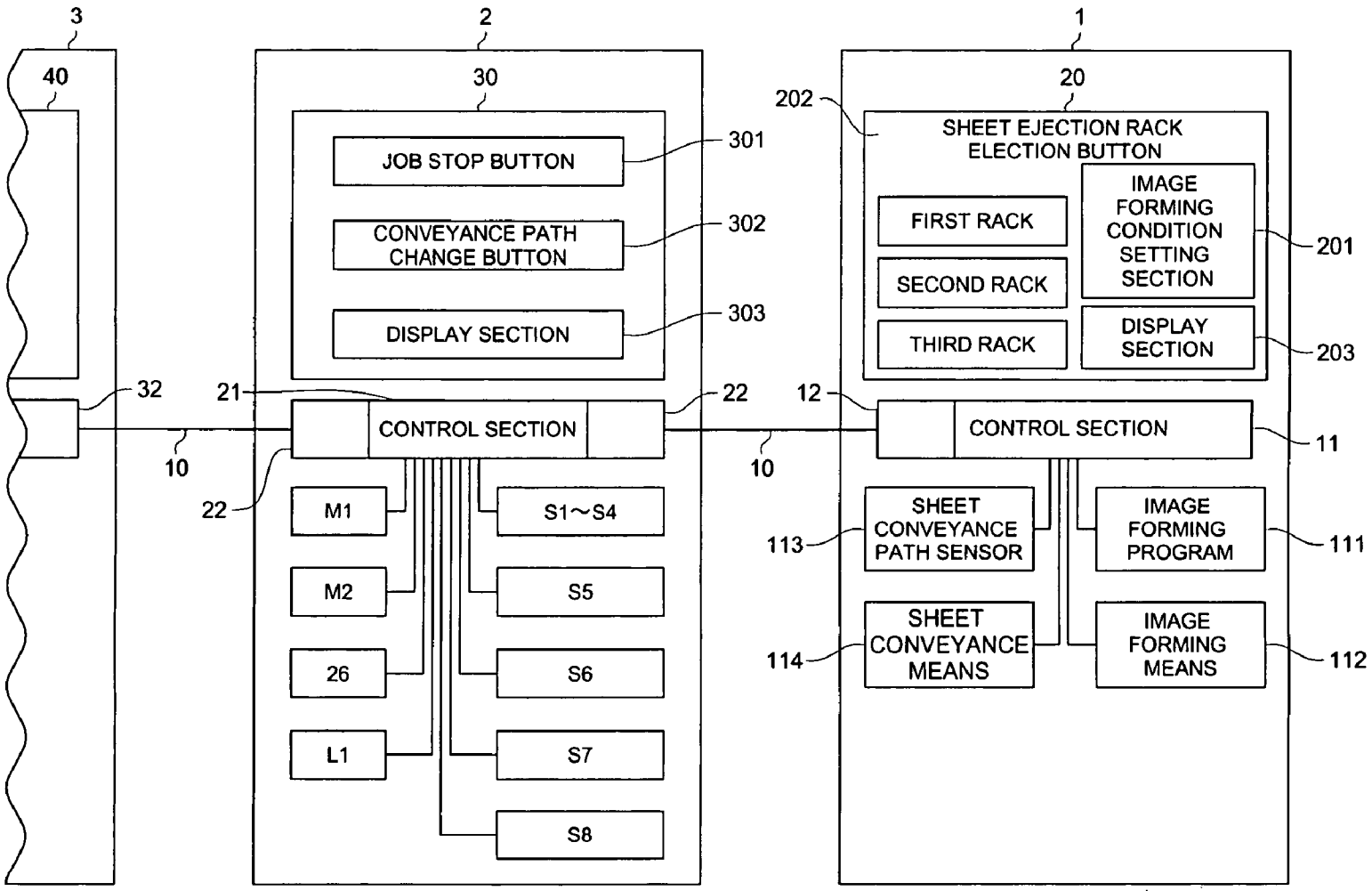
FIG. 6 is a block diagram showing the control system of the image forming system.

(4) FIG. 6 shows the block diagram of the control system of the image forming system.

The image forming conditions setting section 201 and the sheet ejection destination selection button 202 have been provided in the operation section 20 of the image forming apparatus 1, and when the print conditions such as the print density or the number of prints, etc., are input and also the paper ejection destination is input, for example, as the first rack and the start button is pressed, the control section 11 calls the image forming program 111, carries out image formation using the image forming means 112, the image is transferred and fixed onto the paper conveyed by the paper conveyance means 114 and the paper is conveyed to the first sheet stacking apparatus 2.

Connection is made between the control section 11 and the control section 21 of the first sheet stacking apparatus 2 and between the control section 21 and the control section 31 of the second sheet stacking apparatus 3 using serial communication cables 10 via the communication means 12, 22, and 32, and information is exchanged between the control section 11, the control section 21, and the control section 31. Further, the sequence number of connection of that sheet stacking apparatus from the image forming apparatus 1 is stored beforehand in the control section 21 and in the control section 31.

In the present preferred embodiment of the present invention, the control section 21 carries out control upon notifying of messages from the control section 11, the paper discharged from the image forming apparatus 1 is conveyed by the receiving roller 281 and is stacked on to the rack 271 after passing through the stacking path 25 selected by the conveyance path switching means 26. Further, the job stopping button 301, the conveyance path changing button 302 as well as the display section 303 are provided in the operation section 30 of the first sheet stacking apparatus, and the message "Paper being stacked on this rack" is displayed in the display section 303.

Figure 7:
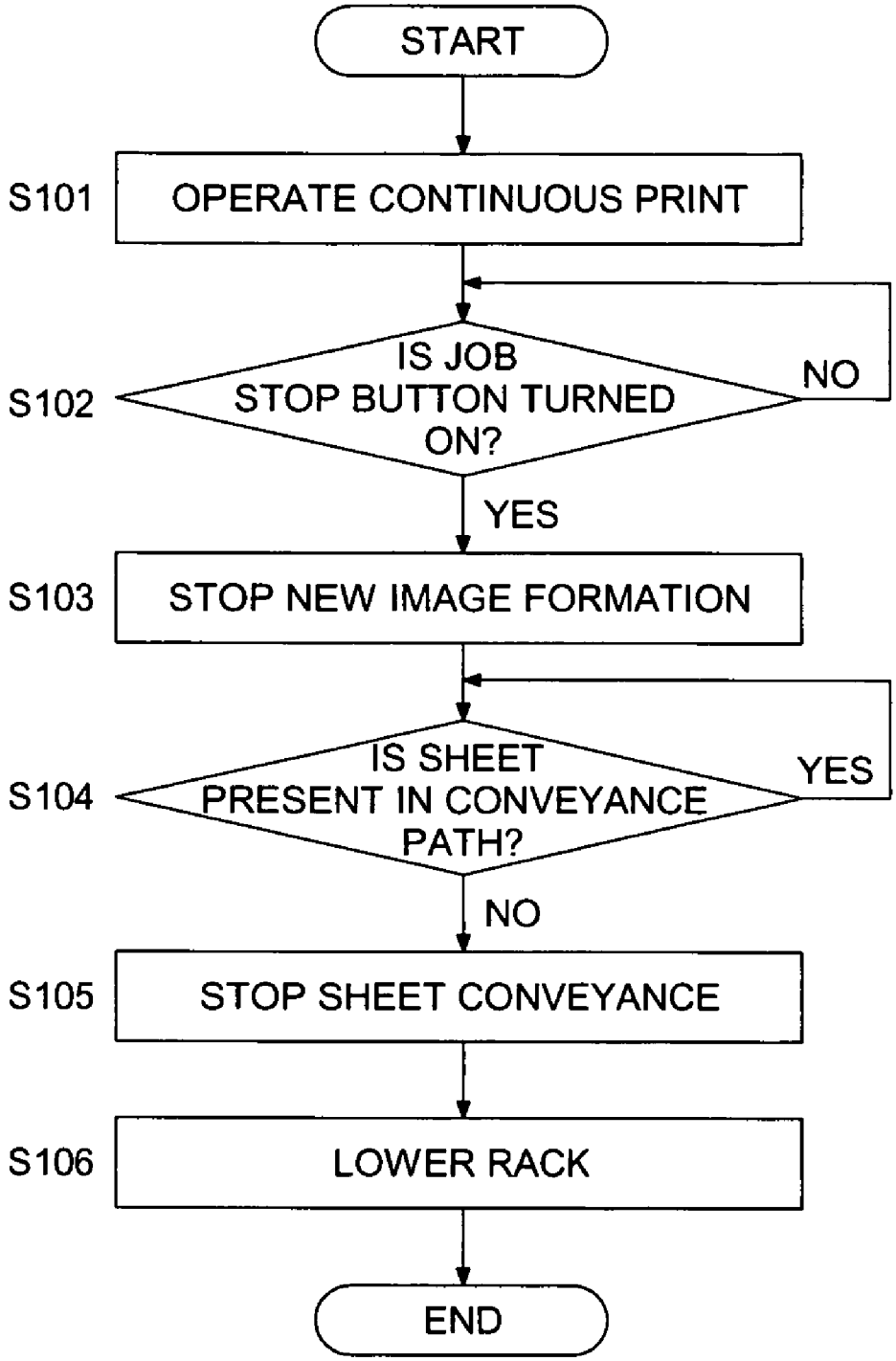

(5) FIG. 7 is a diagram showing the flow chart of operations when the job stopping button 301 is turned ON during the execution of a continuous print job.

When the job stop button 301 is turned ON (Step S102) in the state in which a continuous print is being executed and also the paper discharged from the image forming apparatus 1 is about to be stacked on the rack 271 (Step S101), the control section 21 notifies a message to the control section 11 whereupon the control section 11 stops new image formation in the image forming apparatus 1 (Step S103). However, the presence or absence of a sheet of paper under conveyance in the paper conveyance path within the image forming apparatus 1 is detected by the paper conveyance path sensor 113, and the control section 11 continues to drive the paper conveyance means 114 if such a paper is present and stops the drive of the paper conveyance means 114 when it is detected that all the sheets of paper in the conveyance path from the image forming apparatus 1 have been conveyed to the first sheet stacking apparatus 2.

The paper conveyance status of the sheet of paper conveyed into the first sheet stacking apparatus 2 is detected by the sensors S1 and S2, and when the control section 21 confirms that all the sheets of paper from the stacking path 25 to the inside of the rack 271 have been conveyed (Step S104) it stops the drive to the motor M1 (Step S105). This state is shown in FIG. 5(*c*).

Subsequently, the control section 21 drives the motor M2 and lowers the rack 271 from the receiving position of stacking sheets, and stops the drive to the motor M2 when the lower limit sensor S6 detects that the rack 271 has been lowered to the removal position for removing the lowermost sheet of paper, as is shown in FIG. 5(*d*), (Step S106). The user can then open the door 201 and can remove the sheets of paper stacked on the rack 271.

Figure 8:
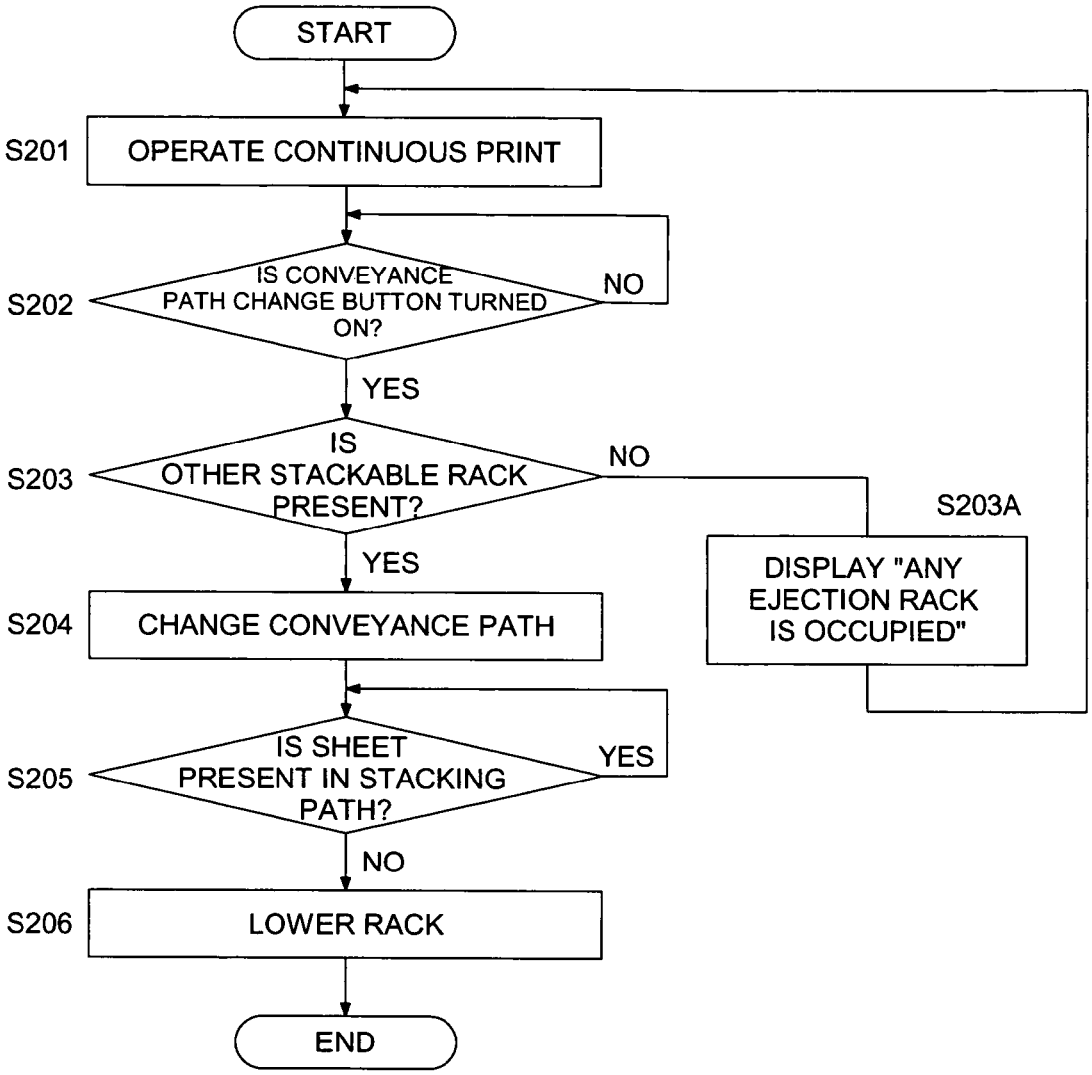

(6) FIG. 8 is a diagram showing the flow chart of operations when the conveyance path changing button 302 is turned ON during the execution of a continuous print job.

When the conveyance path changing button 302 is turned. ON (Step S202) in the state in which a continuous print is being executed and also the paper discharged from the image forming apparatus 1 is being stacked on the rack 271 (Step S201), the control section 21 notifies a message to the control section 11 or to the control section 31 and inquires whether it is possible to stack paper on other racks, on the rack 371 in the present preferred embodiment of the present invention (Step S203). When there is no destination for paper discharge, a message indicating that there is no destination rack for discharging paper is displayed in the display section 303 (Step S203A), and the printing operation is continued without changing the conveyance path (Step S201).

When there is a response that it is possible to stack paper on the rack 371, the control section 21 carries out switching of the conveyance path using the conveyance path switching means 26, and forms the path for conveying paper to the rack 371 (Step S204).

When the control section 21 confirms using the sensor S4 that there is no paper on the stacking path (Step S205), the control section 21 drives the motor M2 and lowers the rack 271 from the receiving position, and stops the drive to the motor M2 (Step S206) when the lower limit sensor S6 detects that the rack 271 has been lowered to the removal position for removing the lowermost sheet of paper (Step S206).

By opening the door 201 in the state in which a continuous print job is under continued execution, the user can remove the sheets of paper stacked on the rack 271. Further, when the door 201 is opened, the discharge path 24 and the stacking path 25 become exposed to view and access as is shown in FIG. 5(*d*). The jam clear operation when paper has got jammed inside is done with the door 201 in the opened condition, and this clearing operation is carried out by removing the jammed paper after opening the conveyance guide section that can be opened and closed and that is provided in the conveyance path.

FIGS. 9(*a*) and 9(*b*) show an example of the conveyance guide section 248 that can be opened and closed and that is provided in the conveyance path 24. The guide plate 248*a* that can open or close the conveyance path can be opened or closed around the rotatable shaft 248*b*. One end of the rotatable shaft 248*b* is provided with a circular plate shaped cam 248*c* with the rotatable shaft 248*b* at its center, and a cam groove 248*d* is provided in the cam 248*c*. Further, a click member 248*e* and a locking member L1 are provided on the periphery of the cam 248*c*.

The guide plate 248*a* is maintained in the open position or in the closed position, respectively when the tip of the click member 248*e* gets engaged with the groove 248*f* or 248*d* at the open position of the guide plate 248*a* at which the conveyance path is opened and at the closed position at which the conveyance path is formed. FIG. 9(*b*) shows the open state of the conveyance path. Further, the construction is such that, at the closed position of the guide plate 248*a*, the plunger that can freely enter the locking member L1 is entered into mates with the cam groove 248*f* thereby locking it, and FIG. 9(*a*) shows the closed position at which paper conveyance is made and this is the locked state in which the opening of the guide plate 248*a* is inhibited.

In the present preferred embodiment of the present invention, since the paper is conveyed when the door 201 is opened and in the state in which the discharge path 24 is exposed, in order to prevent the conveyance path such as the discharge path 24 from being opened by mistake, control is being made so that the locking member L1 operates when the conveyance path changing button 302 is turned ON thereby preventing the conveyance guide section 248 from opening the conveyance path.

What is claimed is:

1. An image forming system comprising:

(a) an image forming apparatus for forming an image on a recording sheet;

(b) a plurality of sheet stacking devices each provided downstream of the image forming apparatus in a conveyance direction of the recording sheet and connected with the image forming apparatus, for stacking the recording sheet delivered from the image forming apparatus; and (c) a controller for controlling the image forming apparatus and the plurality of sheet stacking devices, wherein the plurality of sheet stacking devices comprise:

at least a first sheet stacking device having a first rack for stacking the recording sheet thereon, which is provided downstream in the conveyance direction and connected with the image forming apparatus; and a second sheet stacking device having a second rack for stacking the recording sheet thereon, which is provided downstream of the first sheet stacking device in the conveyance direction and connected with the first sheet stacking device, and (d) a job stop button provided on an operation section always located above at least one of the first and second racks that is turned on by an operator while a job execution is in progress and forcibly stops a printing job by initiating a sequence wherein the controller controls the sheet stacking device in which the job stop button has been turned on to stop a stack of a recording sheet to the rack of the sheet stacking device in which the job stop button has been turned on after the stack of a sheet on which an image is being formed is completed and the stack of the sheet to the rack of the sheet stacking device in which the job stop button has been turned on is completed, and the controller controls the sheet stacking device in which the job stop button has been turned on to move the rack of the sheet stacking device from a stacking position where sheets are stacked to a removal position where the sheets are removed.

2. A sheet stacking device connected with an image forming apparatus for stacking a recording sheet delivered from the image forming apparatus, the sheet stacking device comprising:

(a) a rack for stacking the recording sheet, which descends in accordance with a stacking amount of recording sheets thereon and descends from a stacking position where the recording sheet is stacked to a predetermined removal position where the recording sheet is removed;

(b) a drive motor (M2) for driving the rack to ascend and descend between the stacking position and the predetermined removal position of the rack;

(c) a stacking path through which the sheet delivered from the image forming apparatus is conveyed to be stacked on the rack;

(d) a job stop button provided on an operation section always located above the rack that is turned on by an operator while a job execution is in progress and forcibly stops a printing job; and (e) a controller that controls the drive motor and the sheet stacking device, wherein when the job stop button is turned on while a printing job execution is in progress, the controller controls the sheet stacking device to stop a stack of the sheet to the rack and controls the drive motor to move the rack from the stacking position to the predetermined removal position.

3. The image forming system of claim 2, wherein the controller controls the sheet stacking device to stop the stack of the recording sheet to the rack after the stack of a sheet on which an image is being formed is completed.

* * * * *